US008328031B2

(12) United States Patent
González Sánchez et al.

(10) Patent No.: US 8,328,031 B2
(45) Date of Patent: Dec. 11, 2012

(54) SAFETY STOPPER

(76) Inventors: Francisco Javier González Sánchez, Algete (ES); Jesus Sánchez Diaz, Móstoles (ES)

( * ) Notice: Subject to any disclaimer, the term of this patent is extended or adjusted under 35 U.S.C. 154(b) by 182 days.

(21) Appl. No.: 12/664,607

(22) PCT Filed: Jun. 10, 2008

(86) PCT No.: PCT/ES2008/000418

§ 371 (c)(1), (2), (4) Date: Dec. 17, 2009

(87) PCT Pub. No.: WO2008/152169

PCT Pub. Date: Dec. 18, 2008

(65) Prior Publication Data

US 2011/0174758 A1 Jul. 21, 2011

(30) Foreign Application Priority Data

Jun. 14, 2007 (ES) ..... 200701644
Oct. 17, 2007 (ES) ..... 200702725
May 13, 2008 (ES) ..... 200801369

(51) Int. Cl.
*B65D 55/02* (2006.01)

(52) U.S. Cl. ..... 215/206; 206/534; 206/536; 206/540; 222/48; 222/545

(58) Field of Classification Search ..... 215/206; 206/534, 536, 540; 222/48, 545
See application file for complete search history.

(56) References Cited

U.S. PATENT DOCUMENTS 3,313,441 A * 4/1967 Fadden ..... 215/206
3,407,954 A * 10/1968 Millis ..... 215/206
4,782,963 A 11/1988 Hunter
5,284,262 A * 2/1994 O'Nan ..... 215/206
2002/0179561 A1 12/2002 Peck et al.

FOREIGN PATENT DOCUMENTS

FR 2329535 A 5/1977
WO 8102037 A 7/1981
WO 9521982 A 8/1995

* cited by examiner

*Primary Examiner* — Anthony Stashick
*Assistant Examiner* — Elizabeth Volz
(74) *Attorney, Agent, or Firm* — Edwards Wildman Palmer LLP

(57) ABSTRACT

Intended to prevent the contents of a bottle from being consumed by unauthorized people, both in the case of alcoholic beverages and other hazardous liquids, it consists of a cap itself (47), a sort of upside-down bowl, with a tubular axial prolongation and (46) to guide the joining of the base body onto the pouring neck (44). It attaches to the bottle, the said bowl (47) resting its mouth on a group of outer numbered wheels (50), which in turn rest below on a stopper-bearing (54) that is crossed by a hook (57) resting in turn on the inner sets of wheels (49), which can be moved against the hook (57) by a spring (61). These inner wheels (49) have notches for joining radial plugs (48), notches that are conveniently placed with respect to said plugs to allow the detaching of the cap itself and the consequent opening of the bottle.

1 Claim, 8 Drawing Sheets

SAFETY STOPPER

OBJECT OF THE INVENTION

The present invention relates to a cap that has been especially designed for beverage bottles, particularly for alcoholic beverages such as whisky, brandy, cognac, gin, and in general any bottled drink that costs a considerable amount. The cap also allows the personalisation of a certain bottle, so that it can only be used by a specific customer, the one to whom the bottle belongs.

The cap is also applicable to bottles containing dangerous products, such as for instance bleach and similar substances, thus preventing children or mentally handicapped people from accidentally ingesting these products.

In a more general sense the object of the invention is a cap that can be placed on any type of bottle or package whose contents must be inaccessible to any unauthorised person.

BACKGROUND TO THE INVENTION

Within the area of bottled drinks mentioned above, there are different structural solutions for the sealing of bottles, which in the best cases are aimed at achieving a "sealing" effect, preventing filling or refilling a bottle of a certain brand with a lower quality beverage, which consumers usually refer to as "pulling a switch." This type of cap ensures that the product contained in the bottle really corresponds to the brand name identifying the bottle.

However, within the area of alcoholic beverages there is a totally different problem, especially on the domestic level, although it also occurs in other areas; children and youths have direct access to highly alcoholic beverages, through the bar in their own homes, a problem that to date can only be avoided by keeping alcoholic beverages under lock and key, which is unusual.

It is also relatively frequent that, due to ignorance or for other reasons, a high-quality alcoholic beverage may be unduly used as a condiment in a cooking recipe in which its presence is not even remotely justified.

It is also relatively frequent that in certain public establishments, a customer may reserve a bottle of an certain drink, for his or her particular and sole use, but the current caps for bottles do not give the customer any guarantee that the contents of the bottle cannot be consumed by third parties, or even that the bottle cannot be refilled with a similar product of lesser quality.

In other cases, the issue may be dangerous products, such as for instance certain cleaning products, like bleach, which if ingested may cause serious health problems, particularly in children and the mentally handicapped, who may ingest these products thinking that they are something else.

The applicant has no knowledge of there being any type of cap that allows the selecting of a person or people who may open the corresponding bottle, that is to say, preventing the removal of the contents of the bottle by unauthorised people. There are caps intended to prevent children from having access to dangerous products, but they are based on complicated operations for opening the cap, which often turn out to be difficult even for adults, and which in any case fail to solve the problem of unauthorised people being able to have access to the bottle.

DISCLOSURE OF THE INVENTION

The safety cap that the invention proposes is intended to fill this technological void, allowing any bottle to be securely closed once it has initially been opened, in such a manner that only the owner of the bottle or persons authorised by the owner may open it.

For this reason the aforementioned cap, intended to replace the conventional cap of the bottle when it is first opened, has a combination lock which prevents liquid from coming out of the bottle, except when the cap is in the proper position for liquid to come out, determined by a specific numerical combination or by another type of password, known only to the owner of the bottle, who also, as will be seen below, is the one who establishes the password when the cap is put into use.

So, more specifically, said cap is structured with a threaded body, intended to be screwed onto the neck of the bottle, which is also threaded, to replace the original cap. This threaded body is covered laterally by a bearing that is joined to the body by way of frangible joints, so that in a position of tightening the body to the neck of the bottle to the limit, these frangible joints break and the aforementioned bearing spins around the threaded body without the latter being able to unscrew from the bottle.

The threaded body has an axial hole for the attachment of the rest of the components of the cap, and an off-centre hole for the pouring out of the liquid.

The aforementioned threaded body is complemented by a sort of small tank with an outlet for the liquid and the base of which has an off-centre hole facing the threaded body, as well as a shaft intended to cross the axial hole of the threaded body and to attach conveniently to the latter. Several disks, preferably three in number, are interposed, each one of them having an axial hole for the aforementioned shaft to pass through it, so that in assembly these disks fit closely together, at the same time fitting closely with the upper base of the threaded body and with the lower base of the tank.

Each one of these disks has several perforations on its edge, evenly distributed, off-centre of the radius to coincide with the off-centre holes of the threaded body and the tank, so that each one of the perforations of these disks is susceptible to facing both one of the perforations of the remaining disks and the off-centre holes of the body and tank, defining an outlet for the liquid to be poured out.

These disks are what constitute the combination lock, and for this purpose they have a thin covering strip in one of their sides or bases, closely attached to them, which closes all of the aforementioned perforations, leaving them inoperative.

The different perforations of each disk will be identified from the outside by numbers or any other type of established writing on the edges of the disks, and these can be totally visible when the lower bearing stops upon reaching the level of the disks, or they may be visible through a window parallel to the axis of the cap, when the aforementioned bearing joins the tank, becoming a single piece.

These perforations may also be identified through single steps or angular movements of the disks from a point of reference, in which case said steps are defined by complementary teeth between each disk and the shaft on which they turn.

The disks relate to the shaft through catch-type teeth that, in addition to defining the angular steps of each disk, also allow it to turn only in a certain direction; the different disks turn alternately in opposite directions, so that tripping one of them doesn't cause one or more adjacent ones to be dragged along.

In any case and to establish the password or combination to open the cap, prior to placing the cap on the bottle, the user positions the opening for the disks as he or she sees fit, then places a punch through the off-centre hole of the base body, and perforates the strip of the disks at the level of the selected perforation with the punch, establishing a unique communication through the aforementioned sets of disks.

After placing the cap all together on the bottle, communication between the inside and the outside of the bottle can only be established when the disks have their operative perforations facing one another and at the same time facing the off-centre holes of the body and tank, which will logically only happen when said disks adopt the position corresponding to the password selected.

Evidently, both the number of disks that participate in the cap, as well as the number of perforations in each one of them may be variable in function of the degree of safety desired, namely the maximum number of combinations that can be made.

According to a variant in the making of the safety cap, also maintaining turning disks with alphanumerical inscriptions to determine a password that allows the opening of the cap, and beginning also with the use of a base body that screws, or uses any other means of joining it to the neck of the bottle, the cap has a pouring neck as an axial prolongation of its base body, which communicates with the interior of the bottle or recipient and is intended to receive the cap itself, without moving.

In order to do this, the aforementioned pouring neck has in correspondence with one of its generatrixes an alignment of radial plugs, whereas the cap itself in turn has a bearing with an internal diameter that coincides with the outside diameter of the pouring neck, and which has a slot in the direction of its generatrixes, open at its lower, inner end, and through which the plugs of the pouring neck can be joined.

The aforementioned bearing constitutes the support for several rings marked on the outside, the number of which varies in function of the complexity to be given to the opening combination, but preferably three; these rings have an internal scale, in which several radial plugs are established, facing inwards, complementary to defined spaces in respective toothed crowns, so that in function of the relative axial positioning of rings and crowns, they are riveted angularly or are free, with the function that will be seen below.

Each toothed crown has inside it a slot that can face the plugs of the pouring neck or not, so that when the aforementioned plugs face each other, the cap can be removed freely, whereas in any other position of the toothed crowns, according to the wide range of possibilities for this purpose, these crowns lock the cap of the pouring body itself, as they enter into the slots defined between the plugs.

As an accessory to the structure described, between each ring-toothed-crown pair and the next, as well as outside of them, there are washers with two functions, to tend towards the expansion of the components of the package comprising rings and toothed crowns, and to collaborate with the small protuberances in the toothed crowns to immobilise them so that when a ring is acted on, it pulls the remaining ones along with it.

A cam located at the lower end of the aforementioned package tends to keep the rings and toothed crowns duly covered for the normal operation of the cap, whereas when said cam goes down, these elements come apart, and any of the rings may turn without dragging the corresponding toothed crown, in order to make a change in the password that opens the cap.

A circlip or other similar element acts as an axial retaining mechanism for the plug, made up of the aforementioned elements with respect to the bearing of the cap itself, which has a head that extends up to the level of the periphery of the rings. This has a rounded appendage inside, which, when it is joined to the toothed crowns in the slots of the plugs of the pouring neck, presses against the mouth of the pouring neck, ensuring that it is sealed.

Finally, and according to a second variant in the way that it is made, which is even simpler, the aforementioned washers are replaced with wheels with a "Z" shape and a notch on the most internal or smallest-diameter section, so that when the notches of the different wheels inside are aligned with one another, and they are placed in correspondence with the plugs of the pouring neck, the cap can be taken apart from the bottle in order to remove its contents.

Between the base body and the sets of numbered wheels, there is a stopper-bearing with an "H" shape, whose inner, intermediate wing has small windows through which spikes of a hook pass in a disk that is crossed through the centre both by the pouring neck and by the tubular axial prolongation of the cap that adapts to the outside of said neck, this hook resting in turn on a thickening of the free end of the aforementioned tubular prolongation.

Therefore, the aforementioned hook has a double function, on one hand to keep the stopper-bearing relatively stable, and on the other to support the inner wheels that rest on its spikes and which are pressed against them by a spring placed between the numbered wheels of the upper end and the bottom of the bowl that makes up the cap.

Lastly, it is noted that the hook defines, between its lower disk and its spikes anchored to the stopper bearing, a sector that is wide enough so that pressing against the spring located at the upper end of the cap, the washers in between move their internal sector totally with respect to the riveted sector of the numbered wheels, so that the latter can turn freely with respect to the interior ones, to change the password for the opening of the cap.

DESCRIPTION OF THE DRAWINGS

In order to complement this description and in order to facilitate a better understanding of the features of the invention, a set of drawings of a preferable example of how it is practically made are attached to this descriptive report, showing the following for illustration but not for limiting purposes.

PREFERRED EMBODIMENT OF THE INVENTION

Figure 1:
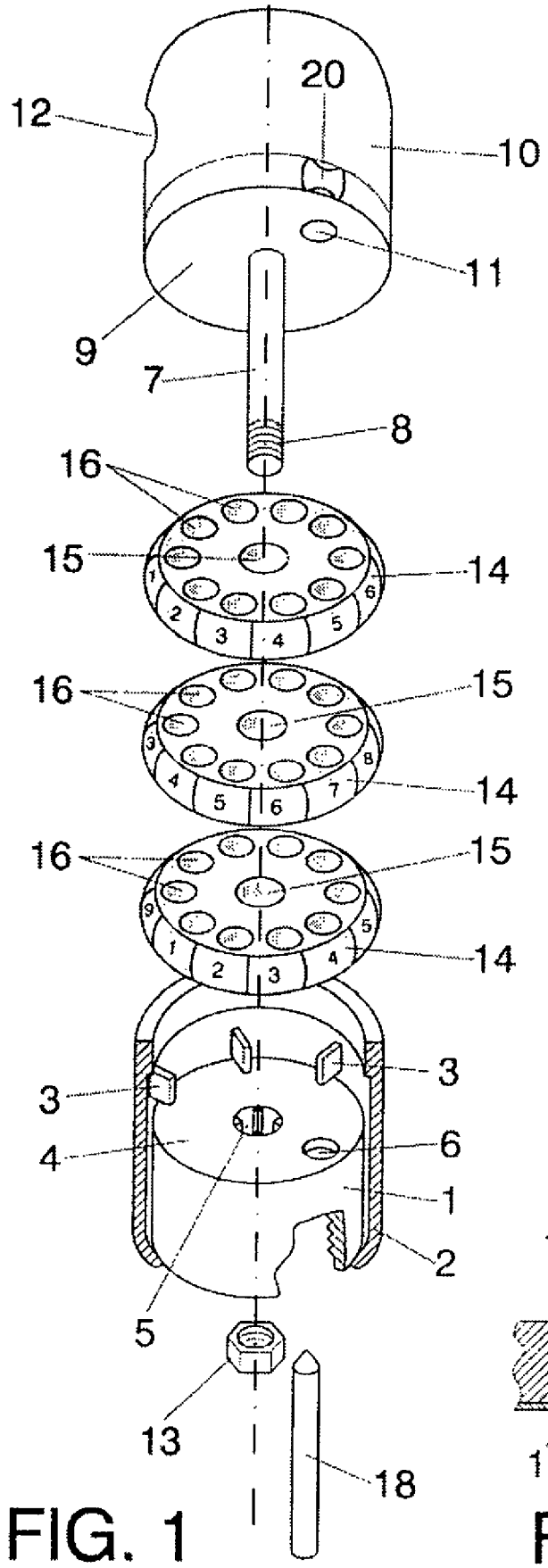
FIG. 1 shows a cap for beverage bottles made according to the present invention, according to a general breakdown diagram in perspective.
Figure 2:
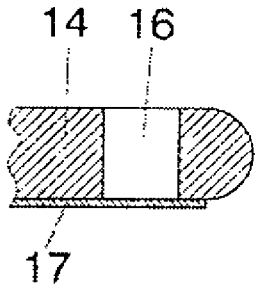
FIG. 2 shows an enlarged detail and a diameter section of one of the disks that participates in the cap of the previous figure.
Figure 3:
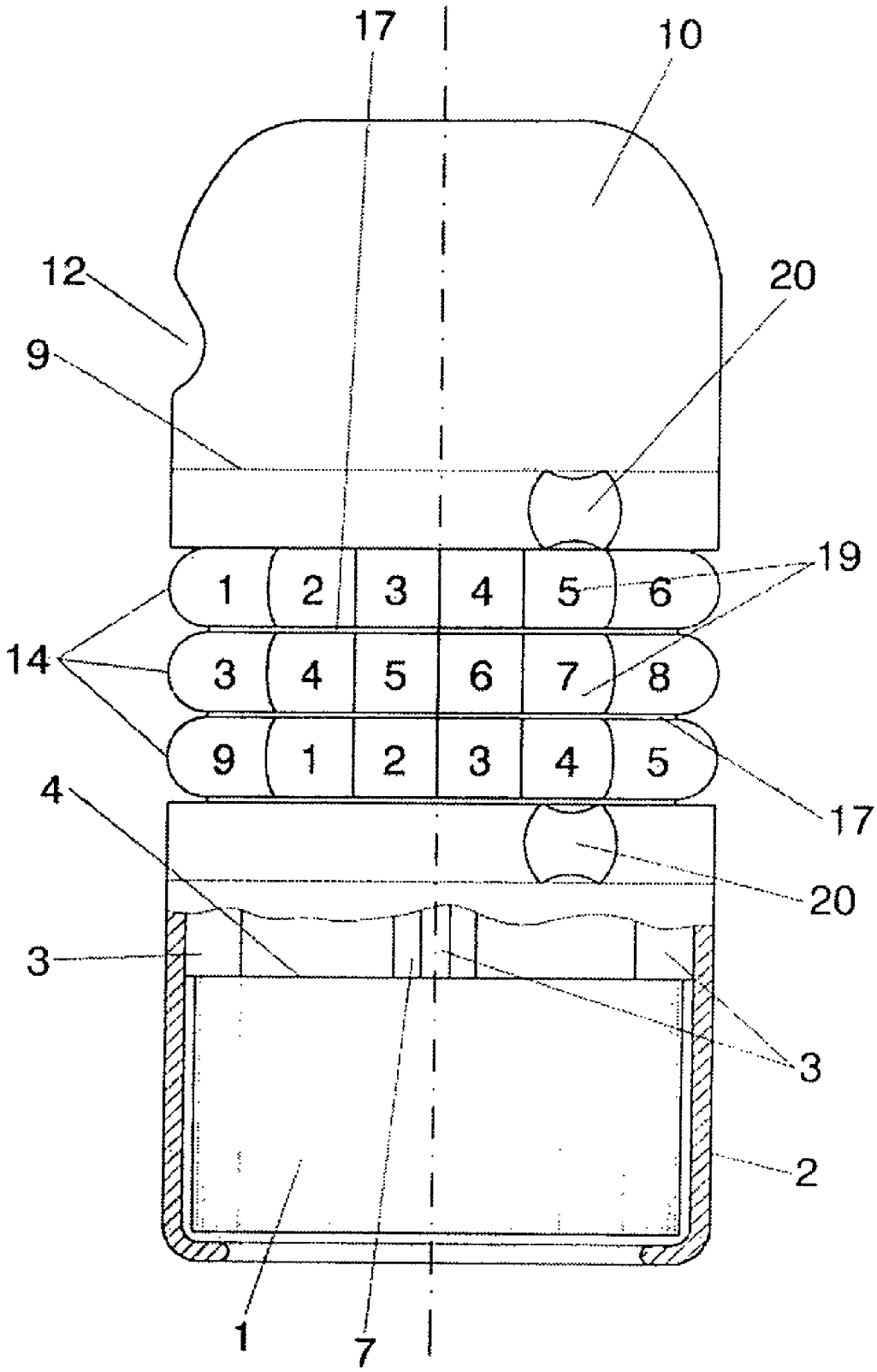
FIG. 3 shows, finally, the set of FIG. 1 duly mounted in accordance to a side elevation view.

In the view of the figures indicated, specifically in FIGS. 1 to 3, it can be seen that the safety cap that the invention proposes is made from the cylindrical threaded body (1), specifically shaped like a bowl that is threaded on the inside so that it can fit with the outer threads of the neck of the bottle, replacing the original cap of the same. The body (1) has its perimeter wrapped around by a bearing (2), preferably a single piece with the body itself (1) and connected to it by frangible joints (3), so that during the operation of placing the cap of the invention on the bottle, when it is tightened as much as possible, the joints (3) break and the bearing (2), which turns loosely, prevents it from giving the body (1) the turning movement necessary for it to be removed from the neck of the bottle.

The body (1) has a central or axial hole (5) in its base (4), and an off-centre hole (6), this latter for the purpose of letting out the liquid, whereas the hole (5) is intended for the passing of a shaft (7) finished with a short threaded section (8) and linked, preferably as a single piece, to the base (9) of a small tank (10) that also forms a part of the safety cap. The base (9) in turn has an off-centre hole (11) facing the hole (6) of the body (1), while the tank (10) has a side outlet (12) for the liquid.

Therefore the tank (10) is attached to the body (1) through the shaft (7) with the aid of a nut (13), although it can also be attached by any other suitable conventional means, in any case interposed with several disks (14) with an axial hole (15), through which the shaft also passes fitting closely (7).

Each one of these disks (14) has a perimeter alignment of perforations (16), of a variable number, off-centre in the same manner as the holes (6) and (11) mentioned above, so that any of the holes (16) of any one of the disks (14), is susceptible to facing holes (6) and (11) of the base body (1) and of the tank (10).

Each disk (14) includes, closely joined to one of its bases or sides, a covering strip (17) that can be perforated, made, for instance, of plastic, which theoretically functionally cancels out all of the perforations (16) of the corresponding disk (14), so that each safety cap, immediately before its use, is inoperative and lacks a password to make it functional.

It is the user of each specific cap who, with the aid of a punch (18) and after establishing the password that he or she sees fit with the disks (14), by placing each one of the aforementioned disks in the proper position, then makes the perforations of the different strips (17), making each disk (14) operative by specifically perforating (16).

In order to do this, the disks (14) can include numerical inscriptions (19) on their edges, as shown in FIG. 3, so that a certain combination of these numbers (19) causes the opening of the cap and therefore the possibility that the liquid can come out of the bottle, although it is also foreseen that for each disk there will only be a certain signal, so that from a position in which the signals of the three disks face each other in a position "0" defined by a picture (20) of the tank and/or of the lower bearing (2), the steps that must be given to each disk in an angular direction, defined for instance by outer teeth on the edge of said disks complementary to others existing on the inner face of the bearing (2). In this case, the aforementioned bearing must partially cover the said disks, leaving a window that is more or less wide, for direct manual access to them.

Finally, it is also foreseen that in order to avoid the undesired dragging of any of the disks when it is acting on one next to it, between the shaft (7) and the axial hole (15) of each disk there is a mechanism that allows the turning of said disks only in a certain direction. It prevents movement in the opposite direction, for instance through a type of catch; the possibility of moving the disks alternates from one direction to the other, so that one can never drag the other adjacent ones with it.

Figure 4:
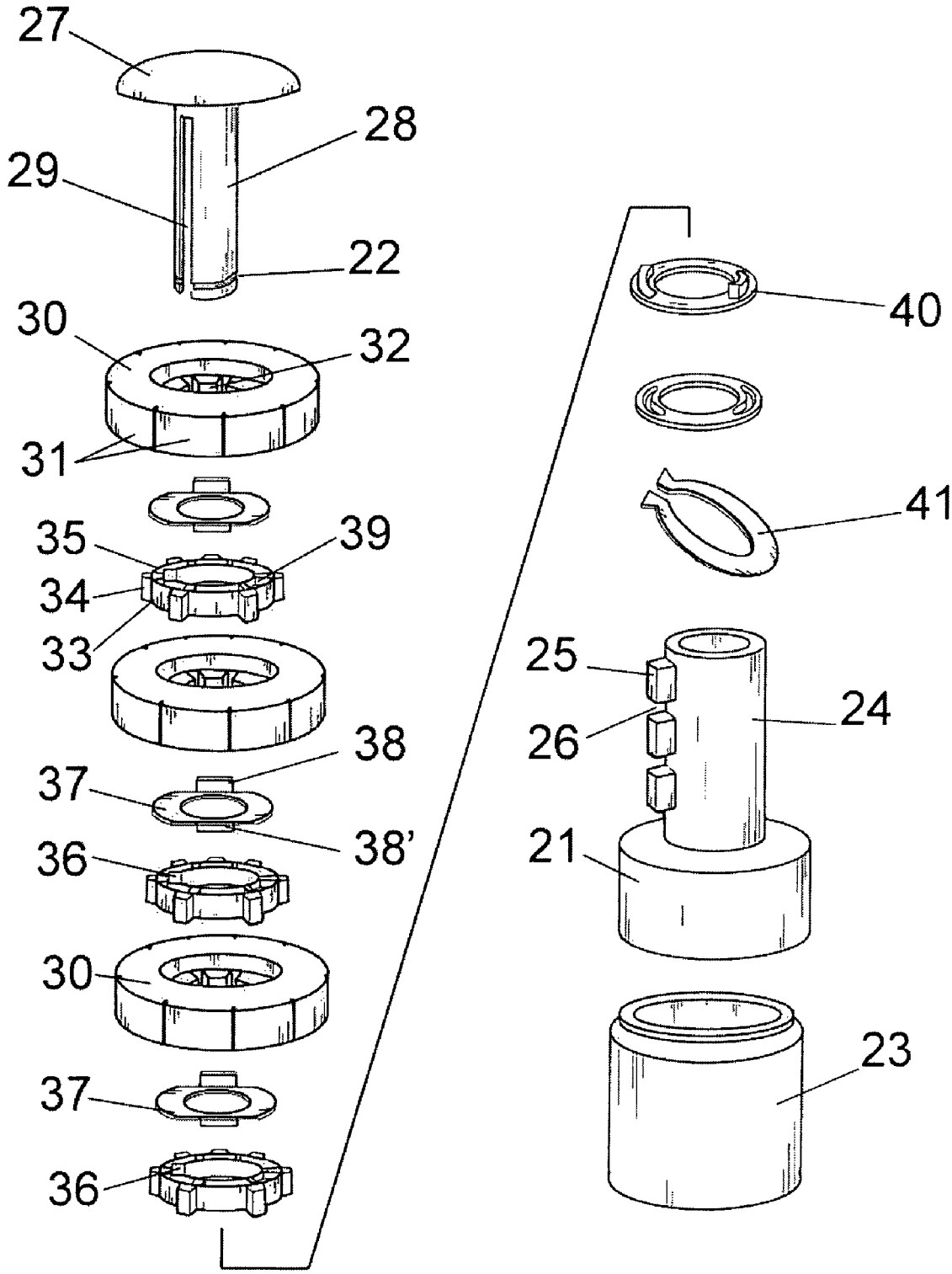
FIG. 4 shows a breakdown diagram in perspective similar to that of FIG. 1, but corresponding to a variant of the practical making of the cap.
Figure 5:
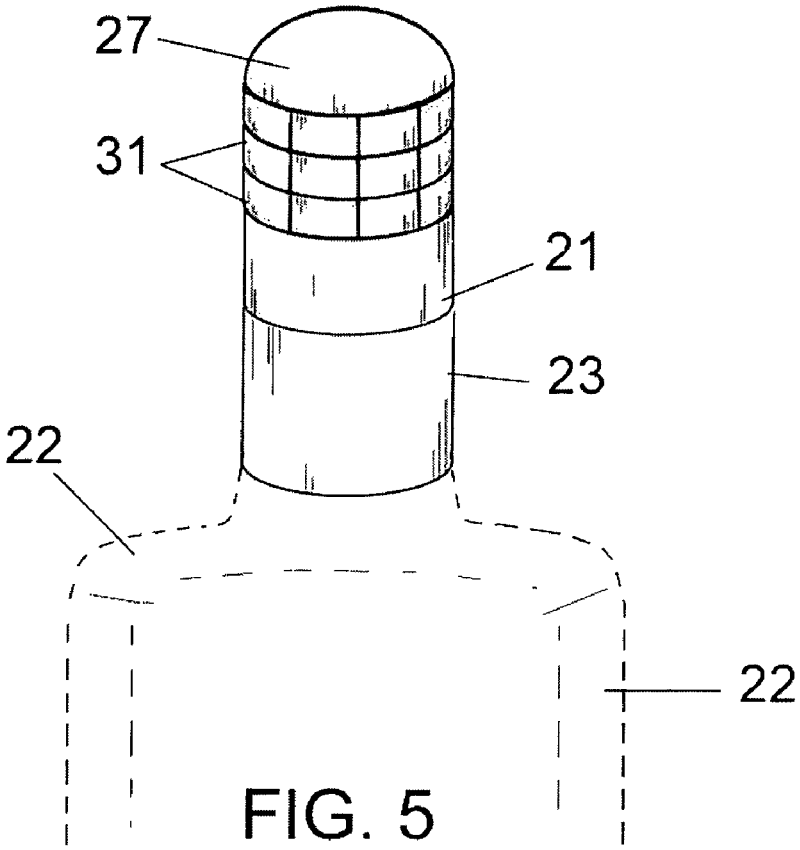
FIG. 5 shows the cap of the above figure duly mounted on a bottle, which has been drawn with dotted lines.
Figure 6:
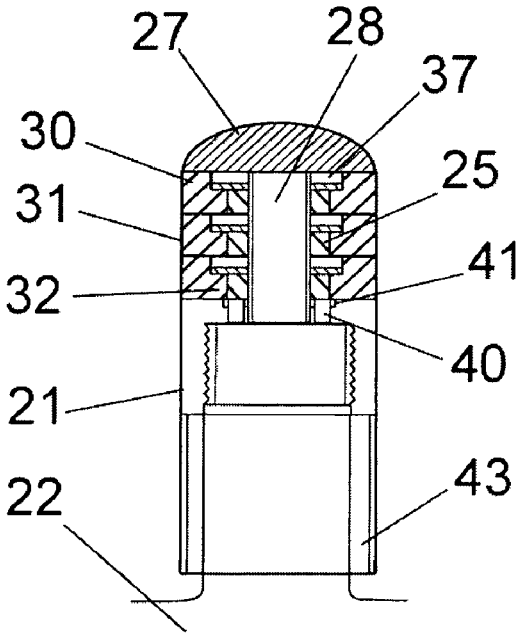
FIG. 6 shows a diameter section detail of the set represented in the above figure.
Figure 7:
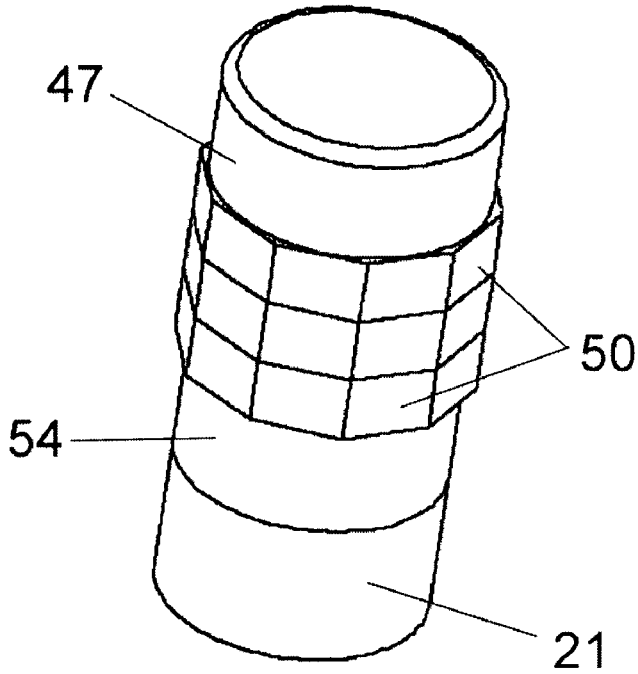
FIG. 7 shows a general perspective view of a safety cap made according to a second variant of the making of the invention.

As mentioned above, a variant of the making of the cap is that shown in FIGS. 4 to 6, where one can see that there is a base body (21) with inner threads (not represented) for joining it to the neck of the corresponding bottle (22), and aided by a seal (23) that guarantees that the cap cannot be separated from the bottle, said base body (21) having the particularity that as an axial prolongation of the same there is a pouring neck (24), small in diameter, through which the liquid comes out when the bottle is tilted.

The pouring neck (24) has a line of radial plugs (25), on one of its generatrixes, which define slots between them (26).

The structure described is complemented with the cap itself (27), provided with an axial bearing (28) whose inside diameter coincides with the outside diameter of the pouring neck (24), to which it is intended to be adapted, and with a slot (29) on one of its generatrixes, open at its free lower end, the size of which is suitable for allowing the passage of the aforementioned plugs (25) of the pouring neck.

This bearing (28) is intended to receive outside several rings (30) with alphanumerical inscriptions (31) on their outer surfaces, such as for instance numbers, these rings (30) having a lowered, scaled edge on the inside, partially occupied by several protuberances or plugs (32) that are radial and face inwards. These are to be anchored into the spaces (33) defined by the teeth (34) of a toothed crown (35), whose inside diameter coincides with the outside diameter of the pouring neck (24) and in the inner periphery of which there is a slot or notch (36) of a suitable size for allowing the axial movement of the cap itself with respect to the pouring neck (24), when the slots (36) of the toothed crown (35) are aligned with the radial plugs (25) of the pouring neck (24). This only happens when the cap itself has had the correct opening combination established.

Between each pair of ring-toothed-crown sets (30-35) and the next one, there are washers (37), with small protuberances (38-38') set against each other, and intended to rest on the different ring-toothed-crown groups (30-35), tending towards the expansion of the package made up of these elements, and also acting in turning on small ribs (39) on the opposing faces of the toothed crowns (35). These define "steps" in the turning movement of the rings (30), which perfectly outline the unitary angular movements of these mobile elements, and also stabilise the rest of the ring-toothed-crown sets (30-35), when one of them is being turned.

In order to attach or detach the rings (30) and the toothed crowns (35) there is a type of clutch that consists of a cam (40) located at the lower end of the bearing (28), just before a circlip (41), which when fitted into an outside perimeter slot of the bearing (28), acts as an axial retaining mechanism for the entire package mentioned.

Finally, in FIGS. 7 to 15 another variant in the practical making of the cap is shown, even more simplified, where the base body itself (21) of the cap and which is also a sort of cylindrical bowl that joins to the neck (42) of the bottle in question, has a catch (43) interposed, assuring that it seals tightly. This bowl (21) extends into a pouring neck (44) of notable length, the free end of which acts as a cover (45) mounted at the bottom of a tubular prolongation (46) of the cap itself (47); the inside diameter of this tubular prolongation coincides with the outer diameter of the pouring neck (44), for a perfect axial, relative movement between both elements.

The pouring neck (44) has, in correspondence with one of its generatrixes, a line of plugs (48), equidistantly distributed, which, in the example of the practical making of the figures chosen are three in number, although this number can vary in function of the level of security foreseen for the cap as a whole. Each plug (48) has an inside wheel (49) and a numbered wheel on the outside (50), each inner wheel (9) having an inner notch (51), especially visible in FIG. 8, that may be placed facing the corresponding plug (48) of the pouring neck (44) or not, and in such a manner that when all of the inner wheels (49) have their notches aligned (51), the cap itself (47) with its accessories is detachable from the base body (21-44), making the bottle open.

In order to achieve this effect, the axial tubular prolongation (46) of the cap itself (47) has a lengthwise slot (52) that allows its free axial mobility with respect to the plugs (48) that don't move. The inner wheels (49) have a polygonal outer perimeter (53), like the internal perimeter of the numbered wheels (50), so that some can be dragged by the latter turning and at an angle, and so that some can move axially with respect to the others.

The "package" of numbered wheels (50) and inner wheels (49) is retained axially and always remains related to the cap itself (47) with the aid of a stopper-bearing (54), represented in detail in FIG. 6. This bearing has an "H"-shaped section, the horizontal branch (55) of which has windows (56) that allow the passage of a hook (57), the one shown in turn in detail in FIG. 9; the hook is made with a type of washer that corresponds to the reference itself (57), from which the spikes stick out (58) with numbers and positions coinciding with windows (56) operatively facing the inner wheels (49), as is seen in FIG. 8.

Figure 8:
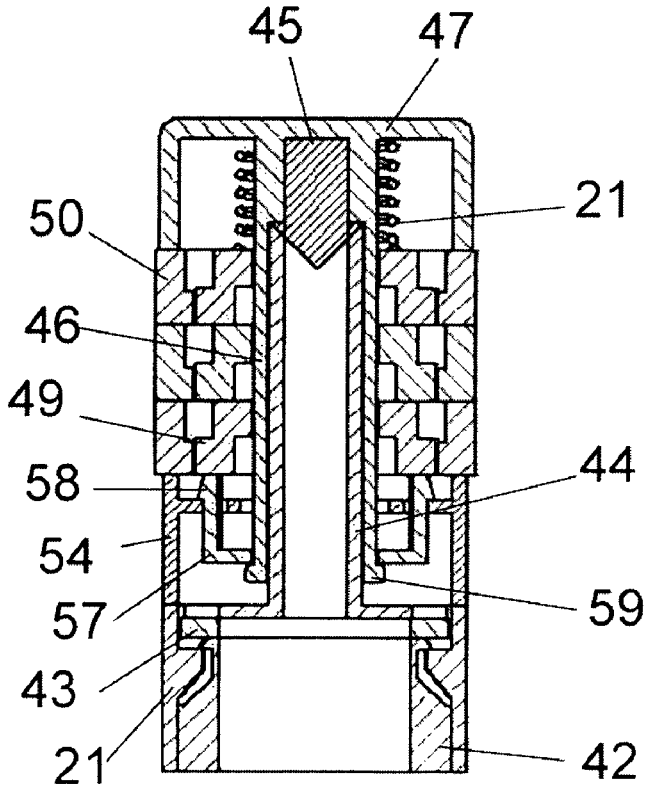
FIG. 8 shows a side elevation view and diameter section of the cap of the above figure, when locked by the same.
Figure 9:
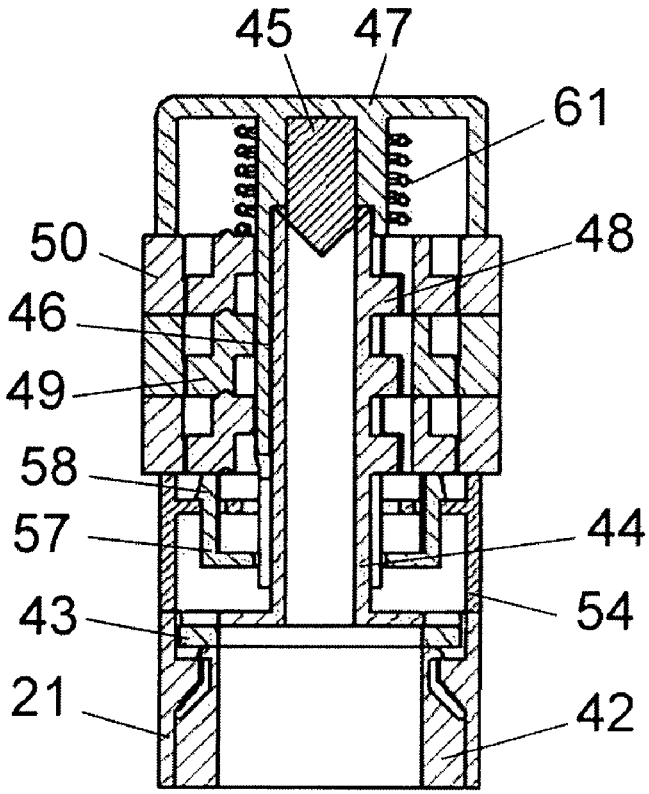
FIG. 9 shows a representation similar to FIG. 8, but corresponding to the cap itself being open.
Figure 10:
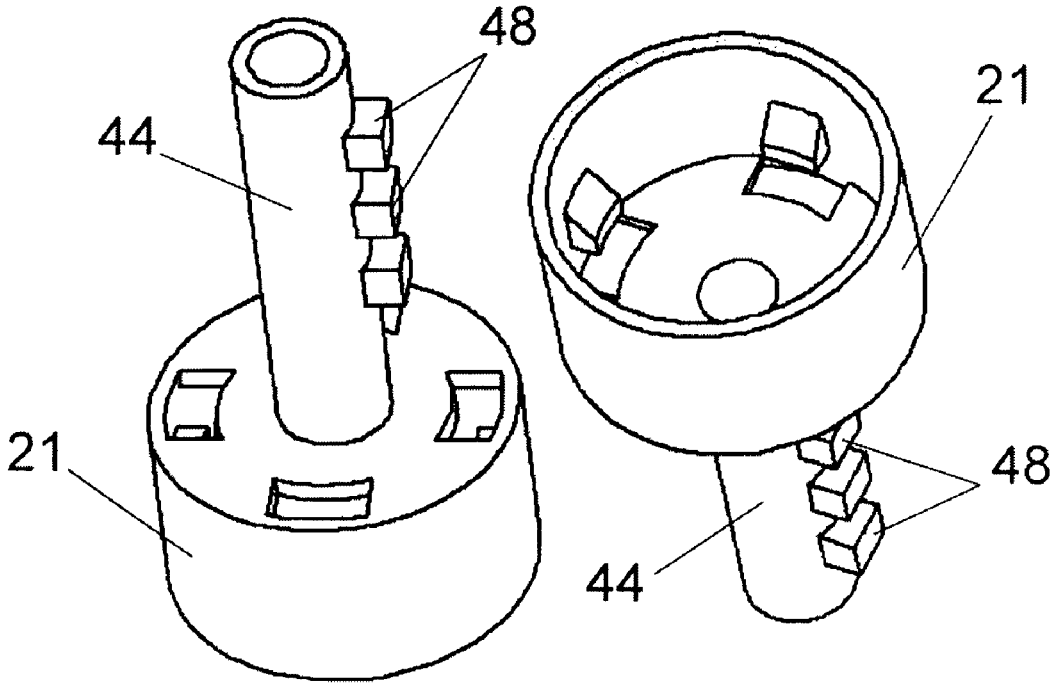
FIG. 10 shows two opposite views of the base body with its corresponding pouring neck.
Figure 11:
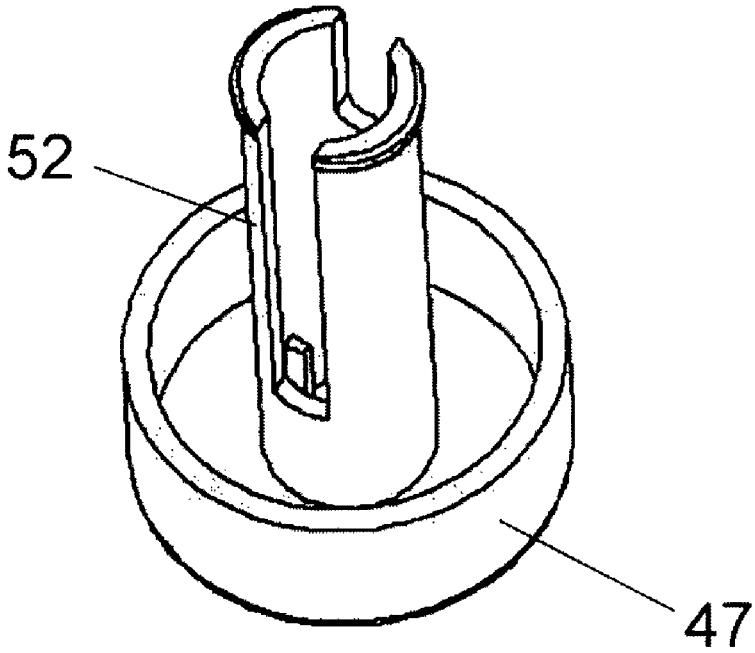
FIG. 11 shows a view of the cap itself from below and to the side.
Figure 12:
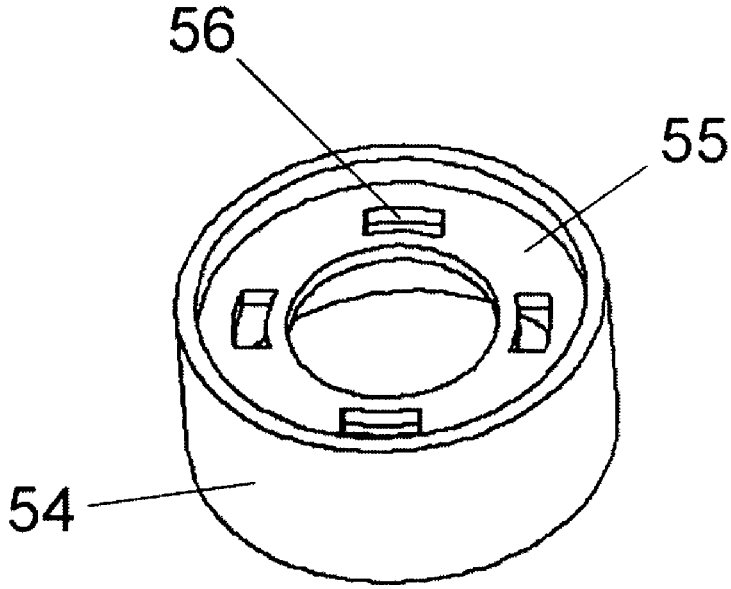
FIG. 12 shows the stopper-bearing in the cap of the invention in a perspective view.
Figure 13:
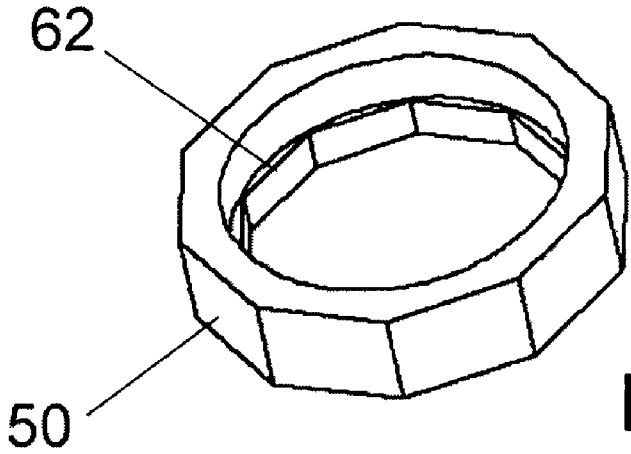
FIG. 13 shows one of the outer numbered wheels from a perspective view.
Figure 14:
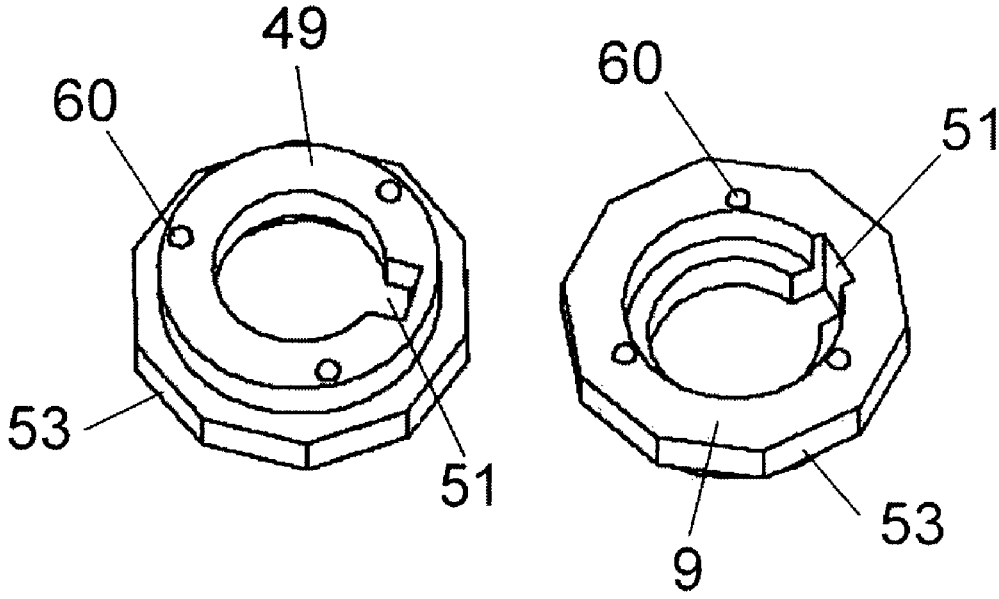
FIG. 14 shows two opposing perspective views of one of the inner wheels.
Figure 15:
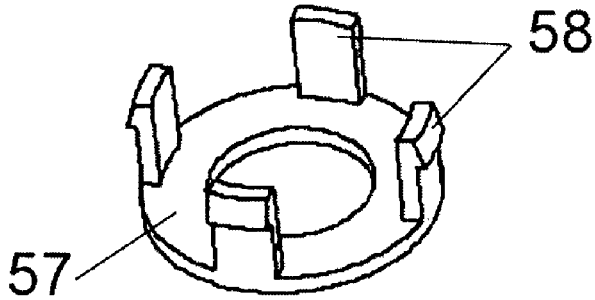
FIG. 15 shows, finally, a perspective view of the hook.

The set made up of the hook (57) and the stopper-bearing (54) is held in place axially by an edge (59) on the free lower end of the axial tubular projection (46) of the cap itself (47), especially visible in FIG. 8.

The inner wheels (49) have small spherical protuberances (60) and complementary depressions the same shape on their faces set against each other. This means that due to the pressure generated between the wheels by a spring (62) located between them and the bottom of the bowl constituted by the cap itself (47), these wheels tend to a keep their relative position stable, and at the same time also adopt pre-established positions that ensure that the plugs (48) of the pouring neck (44) and the notches (51) of the inner wheels (49) face each other properly.

The only thing left to mention is that these inner wheels (49) have a "z" shape and that the outer wheels or numbered wheels (50) only have a polygonal configuration in one of their two halves (62), so that with the cap itself (47) separated from the base body (21) and therefore from the bottle, it is possible to push manually on the hook (57) against the tension of the catch (61), up to a limit at which the inner wheels (49) no longer face the polygonal section (62) of the numbered outer wheels (50), so that the outer wheels (50) can turn freely to change the password for opening the cap.

The invention claimed is:

1. A safety cap, comprising:

a base member configured and adapted to lockingly engage with a bottle opening, the base member including an inner cylindrical body and an outer cylindrical body connected to each other by at least one frangible connection;

a combination member connected to the base member, the combination member including:

a plurality of disks, wherein each of the disks has a plurality of off-center axial holes therethrough, and a frangible membrane disposed across the off-center holes of each disk to provide a selectable fluid connection when the frangible membrane of each disk is punctured by a user driving a punch through one off-center hole in each of the disks to set a custom combination; and a cap member connected to the combination member, the cap member having a fluid outlet for fluid communication from the bottle opening through an off-center hole of each of the disks when the selectable fluid connection of the disks is aligned to provide a fluid conduit to the fluid outlet.

* * * * *